United States Patent [19]

Mack

[11] Patent Number: 4,900,163

[45] Date of Patent: Feb. 13, 1990

[54] DISPOSABLE TRASH RECEPTACLE

[76] Inventor: Judith M. Mack, 84 James St., Kingston, Pa. 18704

[21] Appl. No.: 247,180

[22] Filed: Sep. 21, 1988

[51] Int. Cl.[4] ..... B65D 33/02

[52] U.S. Cl. ..... 383/119; 229/199

[58] Field of Search ..... 383/119; 229/199

[56] References Cited

U.S. PATENT DOCUMENTS

| | | | |
|---|---|---|---|
| 1,486,234 | 3/1924 | Dickey | 383/119 X |
| 1,671,050 | 5/1924 | Snyder | 383/119 X |
| 1,846,542 | 3/1932 | Budd | 383/119 X |
| 2,331,966 | 10/1943 | Eisgrau | 383/119 X |
| 2,678,768 | 4/1950 | Vergobbi | 383/119 X |
| 2,766,926 | 4/1952 | Thompson | 383/119 X |
| 2,802,617 | 8/1957 | Roper | 383/119 X |
| 3,118,588 | 1/1964 | Noble | 383/119 X |
| 3,249,286 | 5/1966 | Palmer | 383/119 X |
| 3,568,918 | 3/1971 | Blomqvist | 383/119 X |
| 4,115,909 | 9/1978 | Corella | 383/119 X |
| 4,138,054 | 3/1979 | Spencer | 383/119 X |
| 4,709,851 | 12/1987 | Vanasse | 383/119 X |

FOREIGN PATENT DOCUMENTS

| | | | |
|---|---|---|---|
| 2523125 | 12/1976 | Fed. Rep. of Germany | 383/119 |
| 2559128 | 8/1985 | France | 383/119 |
| 0627711 | 8/1949 | United Kingdom | 383/119 |
| 0651638 | 4/1951 | United Kingdom | 383/119 |
| 0651804 | 4/1951 | United Kingdom | 383/119 |
| 0966090 | 8/1964 | United Kingdom | 383/119 |
| 2066772 | 7/1981 | United Kingdom | 383/119 |

*Primary Examiner*—Stephen Marcus
*Assistant Examiner*—K. M. Stemann
*Attorney, Agent, or Firm*—Volpe and Koenig

[57] ABSTRACT

A disposable trash receptacle, of rigid or non-rigid construction, that stands independently and can be folded flat is disclosed. It is comprised of a hollow outer body member with an open and a closed end, and a stiffening inner member defining the shape of the receptacle. The inner member has a base and two connected appendages and is inserted into the body member. Both members are of a complementary size and may be secured together by an adhesive.

7 Claims, 3 Drawing Sheets

FIG. 1
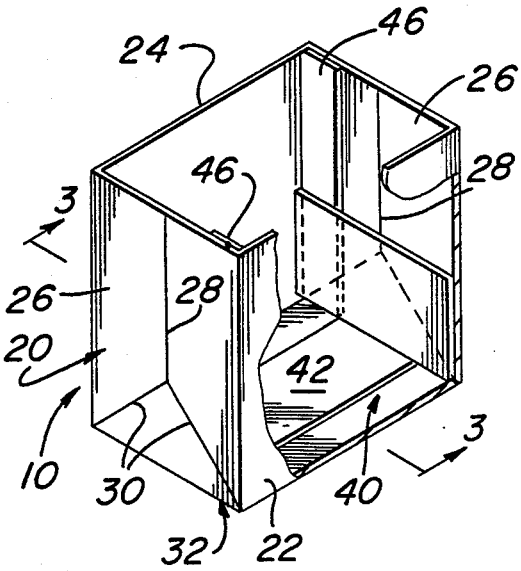
FIG. 2
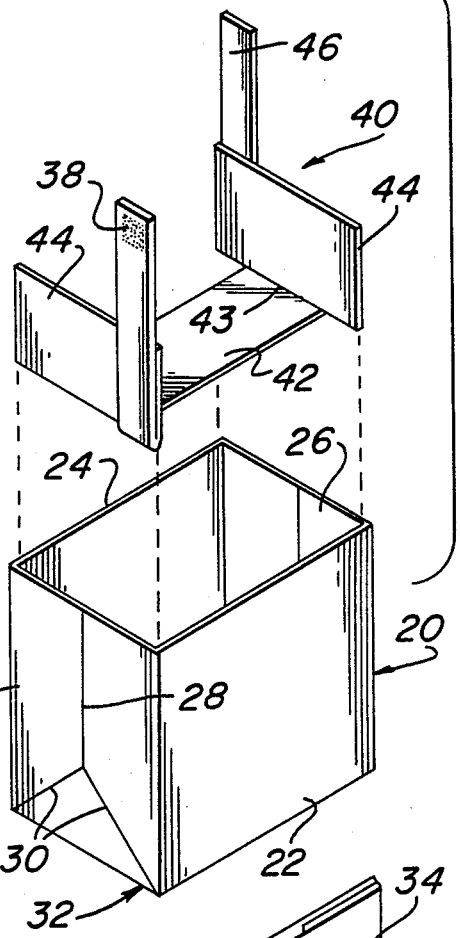
FIG. 3
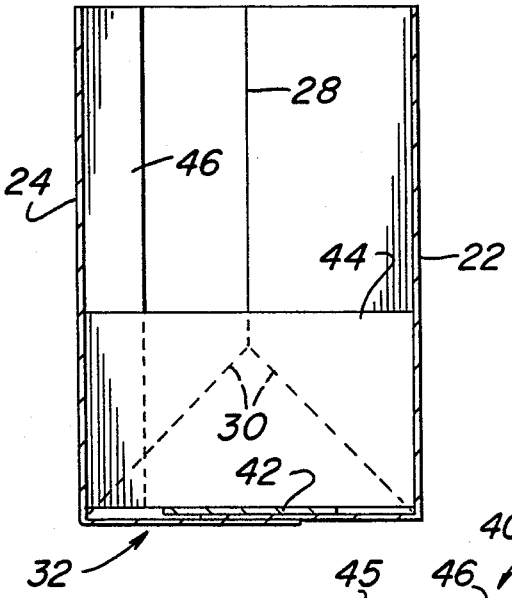
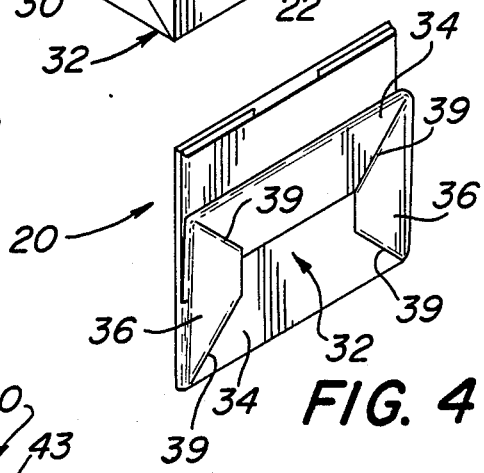
FIG. 4
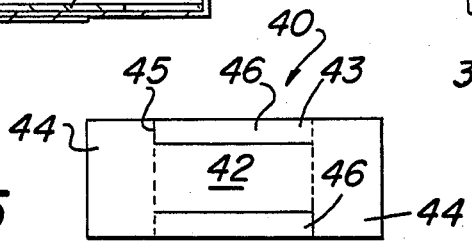
FIG. 5

FIG. 6
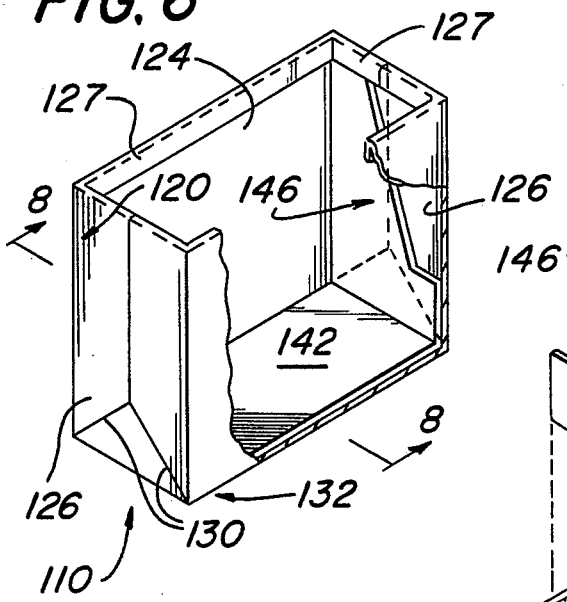
FIG. 7
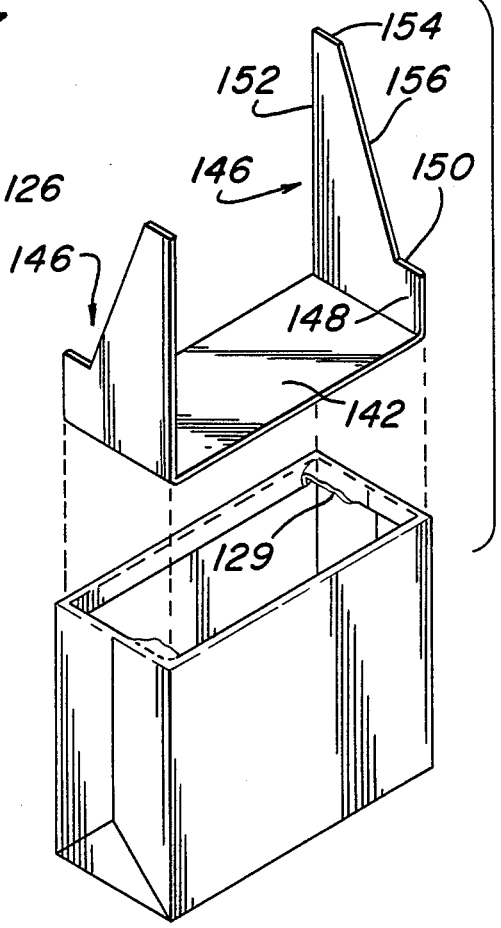
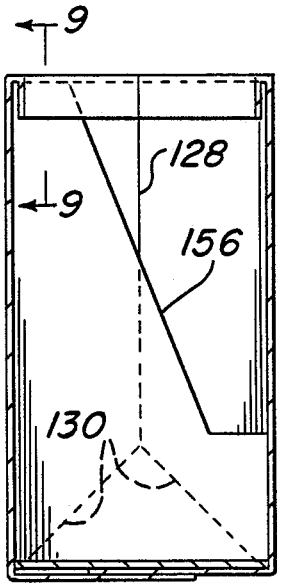
FIG. 8
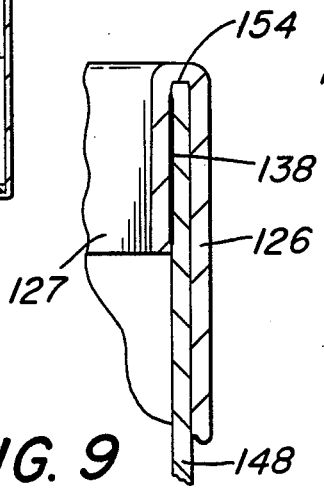
FIG. 9
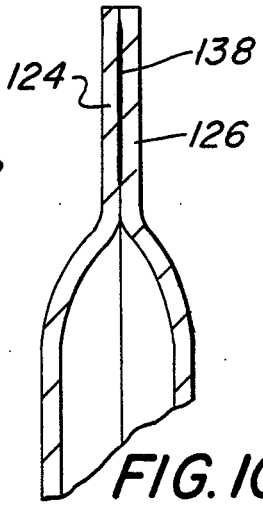
FIG. 10

FIG. 11
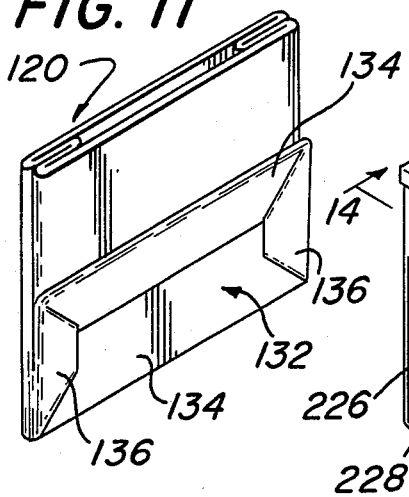
FIG. 12
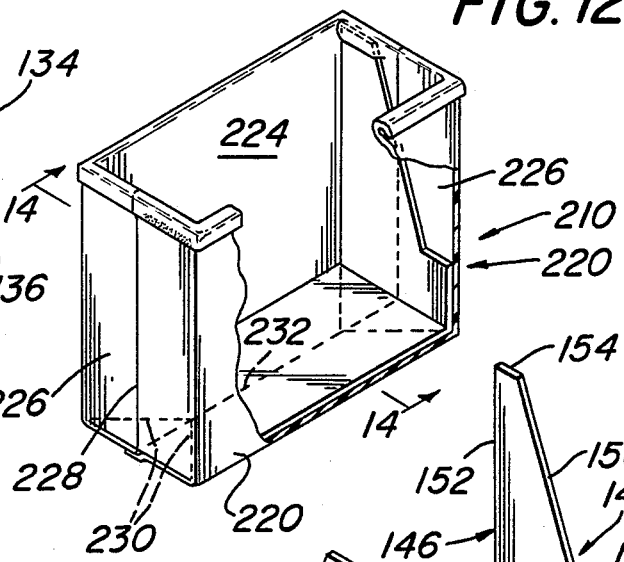
FIG. 14
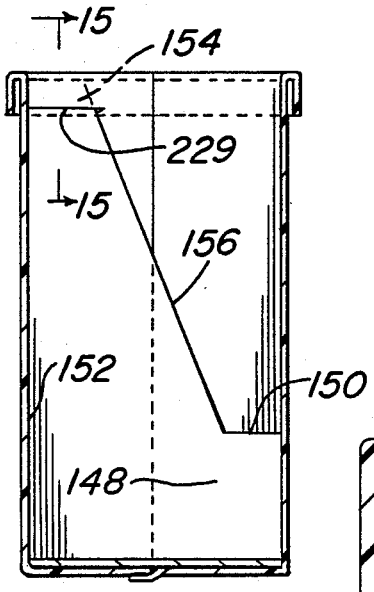
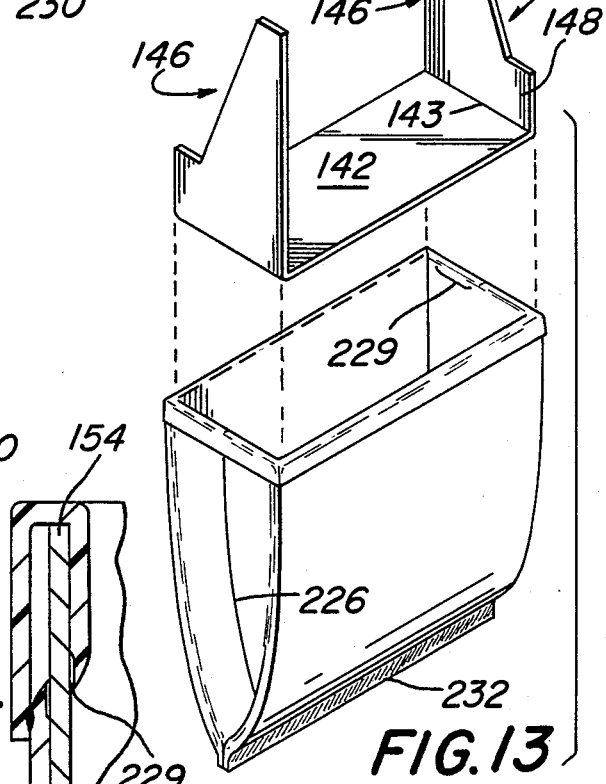
FIG. 13
FIG. 15
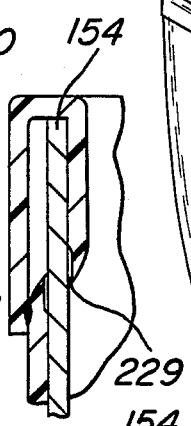
FIG. 16
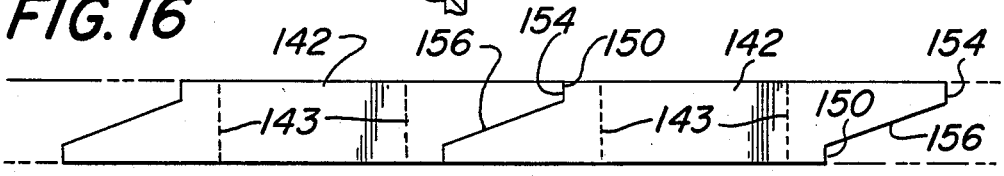

DISPOSABLE TRASH RECEPTACLE

BACKGROUND OF THE INVENTION

This invention relates to a disposable trash receptacle and more particularly to a disposable trash receptacle of a non-rigid construction which is susceptible to being folded flat for shipping and handling prior to use.

There are a variety of trash receptacles having a rigid body shape or configuration. These receptacles are generally intended for repeated use. Although waste material may be directly deposited in the receptacle, it is a common practice to insert a liner or bag into the receptacle prior to depositing waste materials. When it is desirable to dispose of the waste materials, the bag is removed, closed and discarded. In this prior art configuration, the liner or trash bag is generally non-rigid and is draped in the receptacle. As waste material is placed therein, the liner or bag will eventually assume the general configuration of the receptacle.

In addition to the above, it is known to use an open frame for the purpose of supporting a trash bag or liner inside the frame during use as a receptacle. When desired, the trash bag or liner is removed from the frame and discarded.

Although the above described receptacles have found wide use, there is still a need for a trash receptacle that is economically and practically disposable. During use of the prior trash receptacles, it is not uncommon for the receptacle to become soiled and unsightly. The receptacle must be washed or cleansed for both appearance and health purposes. The present disposable receptacle eliminates that requirement.

In addition to the above benefits, the present invention provides a substantial benefit for medical and commercial facilities.

In the medical area, the disposable receptacle will eliminate the need for permanent trash receptacles in hospitals, clinics, patient treatment rooms and other areas where it is desirable to maintain sanitary conditions. In addition to the sanitary benefits, the present invention also provides the user with an opportunity to designate the waste materials placed in the receptacle. For example, receptacles intended for medical purposes may be identified as containing needles, body waste or biological materials and non-contaminating articles such as office waste products. Such a system of identification would permit easy recognition of the waste contained within the receptacle and would assist in the proper disposal of medical waste materials. One suitable material for use in the present invention is the material used in the medical waste bag identified as Catalogue No. 232, available from Pro-Tex-Mor Medical Division, Central States Diversified, Inc., St. Louis, Missouri 63115. This material appears to be flame and moisture resistant.

In the commercial area, the present receptacle would provide a substantial benefit to hotel facilities and public accommodations. Maintenance personnel would not need to be concerned with cleaning the trash receptacle and used trash receptacles could be disposed of quickly and easily.

In the consumer area, the present invention would provide health benefits in areas such as bathrooms and kitchens. Likewise, the present invention would provide the consumer with the opportunity to select trash receptacles with a given decorating motif in mind. For instance, the trash receptacles could be provided in coordination with party supplies or seasonal decorations.

SUMMARY OF THE INVENTION

The present invention provides a disposable trash receptacle which eliminates the need for a traditional, permanent type trash receptacle. The disposable trash receptacle of the present invention is comprised of a hollow body member and a stiffening member. The hollow body member has an open end and a closed end. The hollow body member is generally non-rigid and may or may not have a fixed form.

The stiffening member is received inside of the hollow body member and will substantially define the shape of a trash receptacle. The stiffening member in all embodiments has at least a base and two vertically extending appendages which are operatively connected with the base. The body member and stiffening member are both disposable.

BRIEF DESCRIPTION OF THE DRAWINGS

FIG. 1 is a perspective view of a first embodiment of the invention.

FIG. 2 is an exploded perspective view of the embodiment in FIG. 1 and illustrates the relationship of the body member to the stiffening member.

FIG. 3 is a section through the line 3—3 of FIG. 1.

FIG. 4 is a perspective view of the body member depicted in FIGS. 1 through 3 in its folded condition.

FIG. 5 is a top plan view of the stiffening member shown in FIG. 2 in its flattened and unformed condition.

FIG. 6 is a perspective view of a second embodiment of the invention in its assembled condition with a fragment removed to show the relationship of the stiffening member to the body member in the assembled condition.

FIG. 7 is an exploded perspective view of the embodiment in FIG. 6 illustrating the relationship of the stiffening member to the body member.

FIG. 8 is a section through the line 8—8 of FIG. 6.

FIG. 9 is a section through the line 9—9 of FIG. 8 and illustrates an adhesive assembly for maintaining the stiffening member and body member relative to each other.

FIG. 10 illustrates a trash receptacle, such as that shown in FIG. 9, in which the adhesive has been used to seal the receptacle for disposal thereof.

FIG. 11 illustrates the body member of FIG. 7 in its folded and flattened condition.

FIG. 12 is a perspective view of another embodiment according to the invention.

FIG. 13 is an exploded perspective view of the embodiment shown in FIG. 12 and illustrates the relationship of the stiffening member to the body member.

FIG. 14 is a view taken along the line 14—14 of FIG. 12.

FIG. 15 is a view taken along the line 15—15 of FIG. 14 and illustrates an adhesive means for retaining the stiffening member relative to the body member.

FIG. 16 is a top plan view illustrating a plurality of the stiffening members depicted in FIGS. 7 and 13 in their flattened and unassembled condition.

DETAILED DESCRIPTION OF THE INVENTION

Referring to FIG. 1, there is illustrated the receptacle 10 in its assembled configuration. The receptacle comprises a body member 20 and a stiffening member 40. Body member 20 is comprised of a face 22, a back 24 and sides 26. The base 32 of the body member 20 is closed and the opposite end or top of the receptacle 20 is open. The sides 26 of the body member 20 are provided with a vertical center crease 28 which extends from the top of the receptacle to the apex of the angular creases 30. Each respective angular crease runs from the respective intersection of a side 26 of face 22 or back 24 and the base 32 and extends up to the union with center crease 28. This will be recognized as the creases or fold lines generally associated with paper bag construction.

The body member 20 may be fabricated from a number of disposable materials, such as paper of the type commonly used for grocery bags, plastic sheet materials commonly associated with grocery sacks or shopping bags, or Tyvek® material generally associated with mailing envelopes. In addition to the foregoing materials, body member 20 may be fabricated from paper materials generally recognized as freezer wrap-type paper in consumer applications. For purposes of description, FIG. 1 will be described as a bag constructed of freezer wrap type paper. In this embodiment, the waxed or plastic coated side of the paper will form the interior of body member 20 and the paper side will form the exterior thereof. Through this assembly, it is possible to produce a body member 20 which is substantially water resistant.

As can be seen with reference to FIG. 4, the base of the body member 20 has two large flap portions 34 which correspond in width to the front and back of the body member 20. The length of each of the large flaps 34 is such that they will extend beyond the center line of the base, which is defined by extending an imaginary line between the vertical center creases 28, so that the flaps will overlay each other and provide an area for sealing them together, see FIG. 3. Flaps 36 are then folded inwardly and sealed to the flaps 34 to close the base. The angle lines 39 may be either cut lines, where the material is cut prior to assembly, or fold lines where the material has been folded to establish the flaps, in the manner commonly done in wrapping packages.

With reference to FIG. 2, the assembly of the receptacle of FIG. 1 will be described. The stiffening member 40 is produced by folding a pre-cut and scored blank, depicted in FIG. 5. The cutting and scoring will be described in further detail hereinafter with respect to FIG. 5. Still with reference to FIG. 2, the stiffening member 40 has a base 42 which has a length that is approximately equal to the interior width of base 32. At each end of the base 42 there is provided a vertical side wall or appendage 44. Each side wall has a width which is substantially equal to the interior dimension of sides 26 of the body member 20. Each of the side walls 44 is of sufficient height to extend above the intersection of center crease 28 and angular creases 30. The relationship of base 42 of stiffening member 40 to the base 32 of body member 20 may be seen with reference to FIG. 1. The relationship of side walls 44 to the sides 26 may be seen with reference to FIGS. 1 and 3. In addition to the base and side walls, stiffening member 40 also includes two generally rectangular arms or appendages 46 which extend vertically from the base to a respective side wall 44. The arms 46 are positioned so as to be on opposite ends of their respective side wall 44. If desired, each of the arms 46 may be provided with an adhesive, as illustrated in phantom at 38, which will secure the respective arm 46 to the respective side 26. Alternatively, double sided tape, such as that commonly known as carpet tape, may be provided in small strips. In use, the double sided tape is provided between the arm 46 and the side 26 to secure them together.

With reference to FIG. 5, the stiffening member 40 is formed by cutting a blank of material, preferably cardboard material of about 1 mm in thickness. Such a material is commonly referred to as chip board. The blank is provided by cutting through the material along the two solid "L" shaped lines as indicated in FIG. 5 at 45. In addition, the blank is scored along the two broken lines as indicated in FIG. 5 at 43. Preferably, the score lines 43 are on the face of the blank so that the side walls 44 will fold inwardly and the score line will be internal as depicted at 43 in FIG. 2. As will be known to those skilled in the art, such a score line will provide that back of the blank with a solid material surface which will have some memory and tend to spring the side walls 44 outwardly. The vertical arms 46 are folded back behind and parallel to the side wall 44. In this manner, the vertical arm 46 will be between the side wall 44 and the side 26 of member 20. Due to the memory of the material, the side walls 44 will tend to spring outwardly and this outward tension will stiffen the body member 20. Although the construction of stiffening member 40 is such that it does not require an adhesive means, it is preferred to provide an adhesive means, such as depicted at 38, in this embodiment. By way of an alternative construction of the stiffening member 40, it is contemplated that the score line 43 at the base of each of the respective arms 46 could be made on the back of the blank depicted in FIG. 5. In this construction, the folding of arm 46 behind wall 44 would provide additional material memory which would tend to further tension and stiffen the body member 20. Although the preferred embodiment has been described with a stiffening member 40 constructed of cardboard material, it would be understood by those skilled in the art that other materials, such as plastic, may be utilized. However, in keeping with the intention of the present invention, the materials should be comparatively inexpensive so as to be readily disposable.

With reference to FIG. 4, it can be seen that the body member 20 of FIG. 1 may be easily folded so as to provide a receptacle of reduced volume. This is believed to be an advantage in packaging and distribution of the present invention. Accordingly, a flat stiffening member 40, as depicted in FIG. 5, may be easily packed with a body member 20, as depicted in FIG. 4, in a flat package of relatively small volume.

With reference to FIG. 6 there is depicted a second embodiment of the invention. Elements 110 through 126 and 128 through 136 of this embodiment correspond respectively to elements 10 through 26 and 28 through 36 of their prior embodiment. Accordingly, detailed description for those elements will not be provided. In the present embodiment, it is preferred to form the body member 120 of Tyvek® material. Tyvek® material is recognized as a strong lightweight material which is water resistant. The embodiment of FIG. 6 further differs from the prior embodiment in that this embodiment utilizes a rim 127 around the top interior of the body member 120 and utilized a stiffening member 140 which is of a different construction than that previously described.

With respect to FIG. 6, the rim 127 is constructed by folding the material in and back upon itself. In the preferred embodiment, the rim 127 is generally secured to the interior of the body member 120 by a releasable adhesive. One suitable adhesive is that frequently used with commercially available Tyvek® material envelopes. In this embodiment, the rim 127 is provided with a slotted or pocket portion 129 which is dimensioned to receive the upper end of the vertically extended arm 146. After assembly of the stiffening member 140, the rim 127 may be pressed against the arm 146 to further secure the body member and the stiffening member together.

In the preferred embodiment, the adhesive 138 is preferably applied to the interior surface of the rim 127, see FIG. 9. This configuration provides all of the functions described previously and also provides a means for sealing the receptacle for disposal. With reference to FIG. 10, the disposable configuration will be described further. When it is desired to dispose of the receptacle, the rim 127 may be loosened from the body member 120 and extended vertically. The opposed portions of rim 127 are then brought into contact and with the application of a slight pressure are adhered to each other, see FIG. 10. As with the prior embodiment, the body member 120 and the stiffening member 140 are both disposable.

With reference to FIG. 7, the assembly of the stiffening member 140 with the body member 120 may be easily understood. The stiffening member is inserted into the body member in a manner similar to that previously described and the edge 154 of vertical arm 146 is placed in the pocket formed by the rim 127, as shown at 129. The rim and stiffening member are adhered as previously described.

In the embodiment of FIG. 7, the stiffening member 140 has a substantially rectangular base 142 which substantially corresponds to the interior dimension of the base 132 of body member 120. Each of the generally triangular arms 146 have a rectangular wall 148. As described previously, the rectangular wall 148 has a height between the base 142 and the ledge 150 which is at least equal to the height of the intersection of the center crease 128 and the angular creases 130 from the base 132. As noted previously, the arm 146 terminates in an edge 154. The height of the triangle 152 is substantially equal to the interior height of the body member 120. The hypotenuse 156 runs from the interior termination of edge 154 to the interior termination of ledge 150.

As can be seen with reference to FIG. 8, the hypotenuse 156 crosses center line 128 at a distance substantially above its intersection with angular creases 130. This provides additional shape to the body member 120 and further stiffening of the same. It should also be noted that ledge 150 and edge 154 have substantially the same length.

With reference to FIG. 16, the construction of stiffening member 140 will be further explained. As in the previous embodiment, a cardboard stiffening member is preferred. However, it is recognized, once again, that the stiffening member 140 could be fabricated from plastic or other relatively inexpensive materials. Each of the stiffening members 140 is cut from a strip of material which preferably has a width corresponding to the desired width of the base 142. The strip of material is cut so as to provide ledge 150, edge 154 and hypotenuse 156. Once again, the material is provided with score lines of the face thereof, as depicted at 143, to provide a fold line and material memory. When the ledge 150 and the edge 154 are companion cuts, the blank may be flat folded to reduce its overall size for package. If it is desired to fold the blank so that ledge 150 and edge 154 abut, the base 142 should have a minimum length which is equal to the height 152 plus the height of the rectangular base 148.

With reference to FIG. 11, it can be seen that the embodiment of FIG. 6 can be folded as described for the previous embodiment in connection with FIG. 4.

With reference to FIG. 12, there is depicted another embodiment of the present invention. This embodiment is preferably constructed from tubular plastic film as is commonly used in forming grocery sacks. The construction is similar to that previously described in connection with the prior embodiments. However, in this construction the rim 227 is an external rim. In formation of the body member 220, the tubular material is cut to the desired size and one end thereof is closed, such as by heat sealing. In the preferred construction, the side creases 226 are formed prior to sealing and the lower edge of sides 226 are sealed with the base. This will provide the base of the receptacle 210. Prior to formation of the rim 229, the sides 226 are provided with small slots or cuts, such as by a hot knife, to provide the slot 229, see FIG. 13. The rim 227 is then folded outwardly and over, to provide an exterior rim about the body member 220, and is secured thereto, such as by adhesive or heat sealing as previously described. The slot 229 is preferably positioned to be above the lower edge of rim 227 so as not to be visible from the exterior. In this construction, the edge 154 of stiffening member 140 is inserted into the slot 229 for the purposes previously described. This construction may be seen with reference to FIG. 14.

With reference to FIGS. 12, 13 and 14, it can be seen that the center crease 228 extends from the top of the body member 220 to the closing seal at 232. Unlike the prior construction, the angular creases 30 and 130 are not provided in the side wall. Instead, the material of the side 226 is, as noted previously, preferably extended inward and is sealed at the joint 232. When the stiffening member 140 is inserted into the body member 220, the base 142 will urge the material from the sides 226 downwardly and out. As a result, interior base creases will be formed as depicted at 230 in FIG. 12. The base creases 230 will extend from the joint 232 to the intersection of the sides 226 and the respective back or face 222 or 224. It will be appreciated by those skilled in the art that the size of the joint 232 has been exaggerated in the drawings for purposes of illustration. In reality, the joint 232 will be virtually unnoticed and will not add any substantial height to the body member 220.

It will be appreciated by those skilled in the art that the body member of each of the embodiments may be provided in a variety of colors and/or designs and/or sizes. It will likewise be appreciated by those skilled in the art that the materials selected for the body members are generally non-rigid materials. By non-rigid it is meant that the body member does not have a fixed, preformed shape as is found in prior art receptacles or frames. In the case of the plastic film embodiment, the body member, in addition to being non-rigid, is virtually non-self-supporting, i.e. it will not stand alone.

I claim:

1. A disposable, single use trash receptacle comprised essentially of:

a hollow body member which is closed at one end thereof and open at the other end thereof, the open end having a surrounding rim with at least one slot therein; and a stiffening member, having at least a base and two vertically extending members integrally connected with said base, positioned within said body member with the base immediately adjacent to said closed end with at least one vertically extending member in said slot.

2. The receptacle of claim 1 wherein said at least one vertically extending member is generally rectangular.

3. The receptacle of claim 1 wherein said stiffening member is comprised of two generally rectangular vertically extending members.

4. A receptacle for receiving waste comprising:

a hollow body member having a closed end and an open end including a slot therein; and a stiffening member positioned within said body member, said stiffening member having a base and at least two vertically extending members, a portion of at least one vertically extending member being positioned with said slot.

5. A kit for fabricating a trash receptacle said kit comprising:

a hollow body member having an open end and a closed end, said open end terminating in a slotted rim; and a stiffening member having at least a base and a vertically extending arm, said stiffening member to be positioned within said body member with a portion of said vertically extending arm extending into said slot.

6. The receptacle of claim 5 wherein the body member further comprises front and back panels that are joined by creased side panels for folding said body member into a flattened configuration.

7. A waste receptacle comprising:

a hollow body member having a closed end and an open end including a slot therein; and a stiffening member positioned within said body member, said stiffening member having a base and at least one vertically extending member with a portion of said at least one vertically extending member being positioned within said slot.

* * * * *

UNITED STATES PATENT AND TRADEMARK OFFICE

CERTIFICATE OF CORRECTION

PATENT NO. : 4,900,163

DATED : February 13, 1990

INVENTOR(S) : Judith M. Mack

It is certified that error appears in the above-identified patent and that said Letters Patent is hereby corrected as shown below:

Column 4, line 57, after the numeral "6" insert a --,--.

Claim 4, column 8, line 2, delete the word "with" and insert therefor --within--.

Signed and Sealed this

Twenty-fifth Day of December, 1990

*Attest:*

HARRY F. MANBECK, JR.

*Attesting Officer*

*Commissioner of Patents and Trademarks*